US011697038B2

(12) United States Patent
Satterfield et al.

(10) Patent No.: US 11,697,038 B2
(45) Date of Patent: Jul. 11, 2023

(54) METHOD AND DEVICE FOR SECURING A VERTICAL LINE

(71) Applicant: Huntington Ingalls Incorporated, Newport News, VA (US)

(72) Inventors: Scott Satterfield, Spring Grove, VA (US); Joseph D'Antonio, Williamsburg, VA (US)

(73) Assignee: Huntington Ingalls Incorporated, Newport News, VA (US)

( * ) Notice: Subject to any disclaimer, the term of this patent is extended or adjusted under 35 U.S.C. 154(b) by 332 days.

(21) Appl. No.: 17/014,132

(22) Filed: Sep. 8, 2020

(65) Prior Publication Data

US 2022/0072348 A1 Mar. 10, 2022

(51) Int. Cl.
*A62B 35/00* (2006.01)
*E04G 21/32* (2006.01)

(52) U.S. Cl.
CPC ..... *A62B 35/0068* (2013.01); *A62B 35/005* (2013.01); *E04G 21/3276* (2013.01)

(58) Field of Classification Search
CPC ..... A62B 35/0068; E04G 21/3276
See application file for complete search history.

(56) References Cited

U.S. PATENT DOCUMENTS

| | | | | |
|---|---|---|---|---|
| 6,926,118 | B1 * | 8/2005 | Stevens | E04G 21/3276 248/231.9 |
| 8,261,878 | B2 * | 9/2012 | Grome | E04H 7/065 182/9 |
| 10,207,130 | B2 * | 2/2019 | Cooper | A62B 1/14 |
| 10,344,793 | B2 * | 7/2019 | Choate | F16B 45/00 |
| 10,718,125 | B2 * | 7/2020 | Lopez | E04G 21/3214 |
| 11,433,264 | B2 * | 9/2022 | Golkowski | E04G 21/3276 |
| 2022/0072348 | A1 * | 3/2022 | Satterfield | A62B 35/005 |

* cited by examiner

*Primary Examiner* — Brian D Mattei
*Assistant Examiner* — Kathleen M. McFarland
(74) *Attorney, Agent, or Firm* — Hunton Andrews Kurth LLP

(57) ABSTRACT

An anchor is provided for securing a strand from a wall aperture having a maximum height dimension and a maximum width dimension greater than the maximum height dimension. The anchor has an anchor body member having a first wall engagement surface on a lateral side there-of and a strand-securing aperture. A first hook member is attached to the anchor body member, extends laterally therefrom, and has a second wall engagement surface that intersects and is perpendicular to the first wall engagement surface. A second hook member attached to the first hook member has a longitudinal hook length and a third wall engagement surface parallel to, spaced apart from and opposing the first wall engagement surface. The first and third engagement surfaces define a slot with a width greater than the wall thickness. The longitudinal hook length is less than the maximum aperture width and greater than the maximum aperture height.

14 Claims, 7 Drawing Sheets

METHOD AND DEVICE FOR SECURING A VERTICAL LINE

BACKGROUND OF THE INVENTION

This application relates generally to anchoring mechanisms and hooks and, more particularly, to a device and method for suspending a vertical line from an aperture formed through a vertical wall.

Certain work environments require workers to be secured by an anchored safety line to prevent falls and consequent injuries. In some instances, workers may be presented with an environment where re-anchoring is required to allow movement within the environment, but anchoring points are limited. In the ship-building industry, such an environment is often presented when workers must operate inside large tanks where they can be exposed to fall hazards as great as twenty feet or more. Such tanks may provide few places to secure lifelines to allow safe transit into and through the tank. In some cases, there may be an overhead cross beam or a bulkhead or coming that allows for the installation of a clamp from which a line can be suspended. This approach is cumbersome, however, and requires two hands for installation. As a result, workers may forgo fall protection altogether rather than make use of a system they view as more dangerous than the alternative.

SUMMARY OF THE INVENTION

An illustrative aspect of the invention provides an anchor for securing a strand from an aperture in a wall having a front wall face and a back wall face defining a wall thickness there-between. The aperture has a maximum height dimension and a maximum width dimension that is greater than the maximum height dimension. The anchor comprises an anchor body member having a longitudinal axis and a parallel longitudinal body length dimension running from a strand attachment end of the anchor body member to a hook end of the anchor body member. The anchor body member also has a first wall engagement surface on a lateral side of the anchor body member and a strand-securing aperture formed through the anchor body member adjacent the strand attachment end. The anchor further comprises a first hook member attached to the anchor body member adjacent the hook attachment end. The first hook member extends laterally from the anchor body member in a direction perpendicular to the longitudinal axis and has a second wall engagement surface that intersects and is perpendicular to the first wall engagement surface. The anchor still further comprises a second hook member attached to the first hook member and having a longitudinal hook length dimension running from a hook member attachment end to a free hook member end. The second hook member also has a third wall engagement surface parallel to, spaced apart from and opposing the first wall engagement surface. The first and third engagement surfaces define a slot having a slot width that is greater than the wall thickness. The longitudinal hook length dimension is less than the maximum aperture width dimension and greater than the maximum aperture height dimension.

Another illustrative aspect of the invention provides a method of anchoring a strand for suspension from an aperture in a vertical wall having a front wall face and a back wall face defining a wall thickness there-between. The aperture has a maximum height dimension and a maximum width dimension that is greater than the maximum height dimension. The method comprises providing a strand anchor comprising an anchor body, a first hook member, and a second hook member. The anchor body member has a longitudinal axis and a parallel longitudinal body length dimension running from a strand attachment end of the anchor body member to a hook attachment end of the anchor body member. The anchor body member also has a first wall engagement surface on a lateral side of the anchor body member and a strand-securing aperture formed through the anchor body member adjacent the strand attachment end. The first hook member is attached to the anchor body member adjacent the hook attachment end and extends laterally there-from in a direction perpendicular to the longitudinal axis. The first hook member has a second wall engagement surface intersecting and perpendicular to the first wall engagement surface. The second hook member is attached to the first hook member and has a longitudinal hook length dimension running from a hook member attachment end to a free hook member end. The second hook member also has a third wall engagement surface parallel to, spaced apart from and opposing the first wall engagement surface. The first and third engagement surfaces define a slot having a slot width that is greater than the wall thickness and the longitudinal hook length dimension is less than the maximum aperture width dimension and greater than the maximum aperture height dimension. The method further comprises securing the strand to the strand anchor using the strand-securing aperture and placing the strand anchor in an installed condition in which a portion of the anchor is disposed through the aperture and a portion of the wall is disposed within the slot. In this condition, at least a portion of the first wall engaging surface is adjacent or in contact with the front wall face and at least a portion of the third wall engaging surface is adjacent or in contact with the back wall face.

BRIEF DESCRIPTION OF THE DRAWINGS

The invention can be more fully understood by reading the following detailed description together with the accompanying drawings, in which like reference indicators are used to designate like elements, and in which.

DETAILED DESCRIPTION OF THE INVENTION

While the invention will be described in connection with particular embodiments, it will be understood that the invention is not limited to these embodiments. On the contrary, it is contemplated that various alternatives, modifications and equivalents are included within the spirit and scope of the invention as described.

Figure 1:
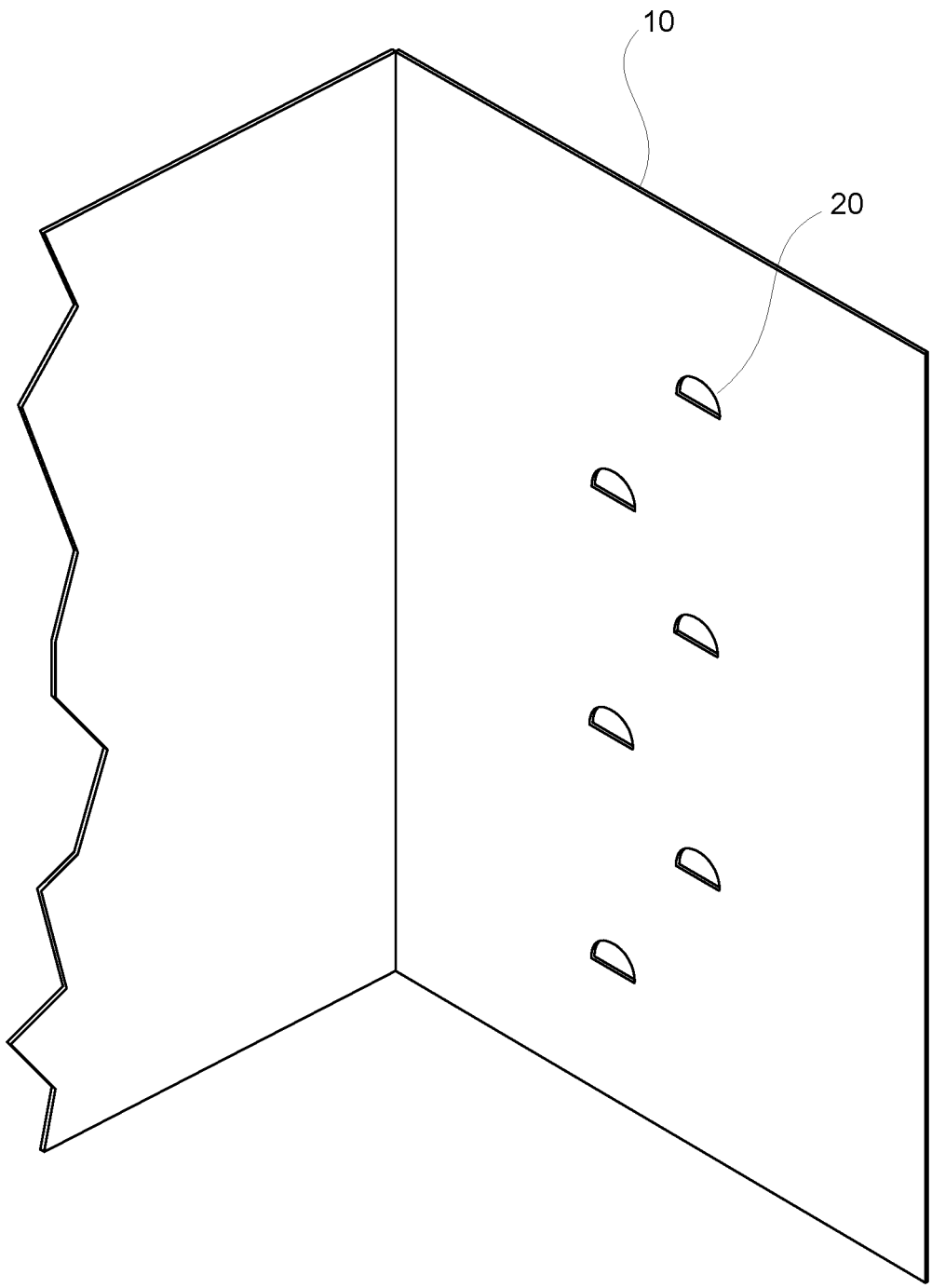
FIG. 1 is a schematic representation of a portion of a tank having a vertical wall with apertures usable in conjunction with embodiments of the invention.
Figure 2:
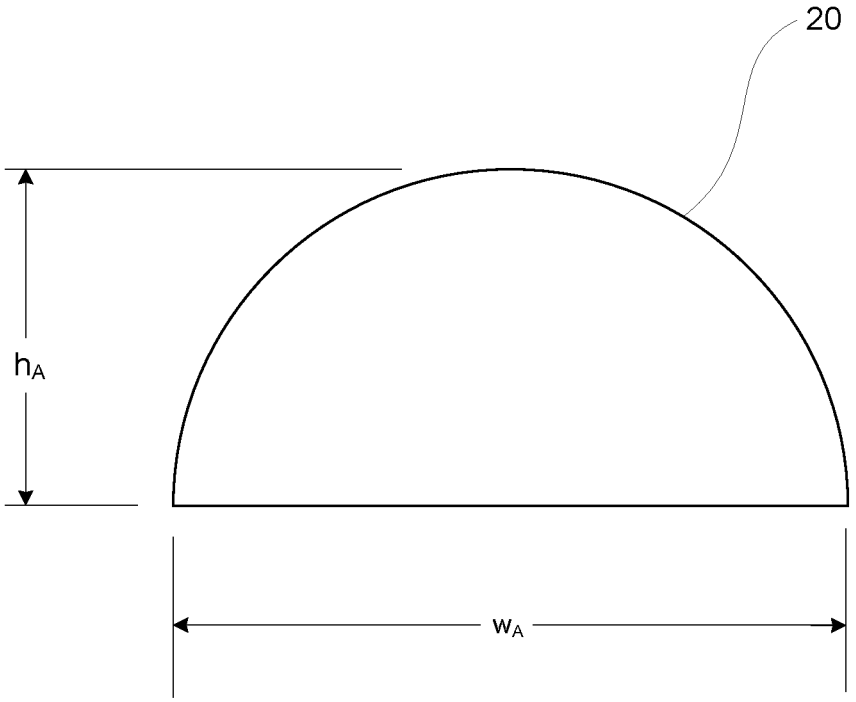
FIG. 2 illustrates a wall aperture usable in conjunction with embodiments of the invention.

A goal of the inventors was to establish a fall arrest attachment point and anchoring system that provides a secure attachment point while transiting through or along a vertical wall (e.g., a tank wall), but that also allows safe and easy one handed installation, removal and movement. The inventors noted that while the tanks in question often lack overhead structure, they typically have apertures formed in the walls to provide foot or hand-holds. As shown in FIGS. 1 and 2, a vertical wall 10 such as might be found in a ship-board tank may have multiple foot-hold apertures 20 having a roughly semi-circular or "half-moon" shape. Other geometries may also be found, but all will typically have a maximum width dimension $w_A$ that is greater than the aperture's maximum height dimension $h_A$. For perspective, in shipboard environments, $w_A$ will generally be in a range of 5.0 to 10.0 inches and more typically in a range of 6.0 to 7.0 inches while $h_A$ will generally be in a range of 2.0 to 6.0 inches and more typically in a range of 3.0 to 4.0 inches.

While these apertures present a potential anchoring point, it was found that existing anchors were either unusable, required two hands for installation, or caused damage to the tank wall surface or surface coating.

The present invention provides a vertical lifeline anchor that is configured to be able to fit/lock into half-moon and other wall apertures. While the anchors of the invention may be used on walls of any thickness, they may be particularly useful in relation to walls with thicknesses of at least 0.375 in. and, most advantageously, in a range of 0.375 in to 0.625 in The shape of the anchor is designed so that it can be installed into a half-moon using one hand and be locked in position without additional steps. The anchor is secured/installed into the half-moon by rotating the anchor sideways into a horizontal position, inserting the back side of the anchor until it protrudes through the wall or bulkhead, then rotated into a vertical position so that the wall is captured within a slot between the main body of the anchor and an extended hook member. With these simple steps, the anchor is locked into the aperture. The elements of the anchor are sized so that if the anchor is subjected to uplift resulting in vertical movement, it still cannot be pulled back through the aperture. More specifically, the extended hook member is sized so that it can fit through the max width portion of the aperture when it is turned sideways but cannot fit through the max height portion of the aperture when it is turned vertically.

The anchors of the invention can be used to secure any form of strand including, without limitation, ropes, cables, twine, chains, belts, or straps. The anchors of the invention are particularly suited to all fall arrest lifelines meeting OSHA requirements.

Figure 3A:
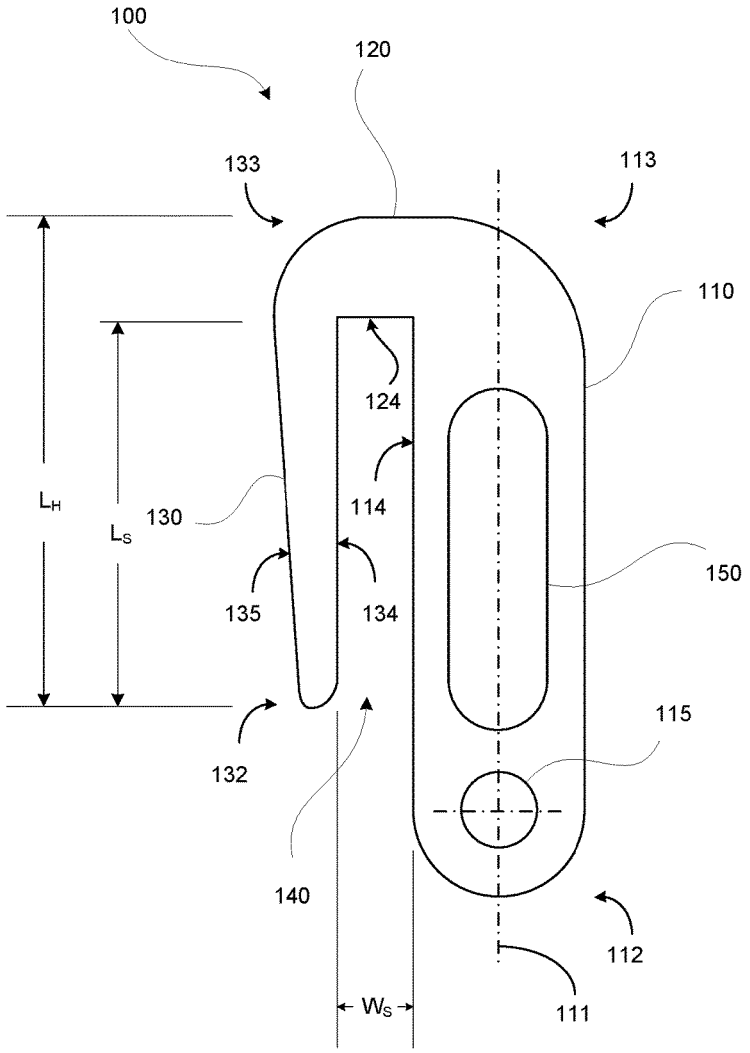
FIG. 3*a* is a front view of a strand anchor according to an embodiment of the invention.
Figure 3B:
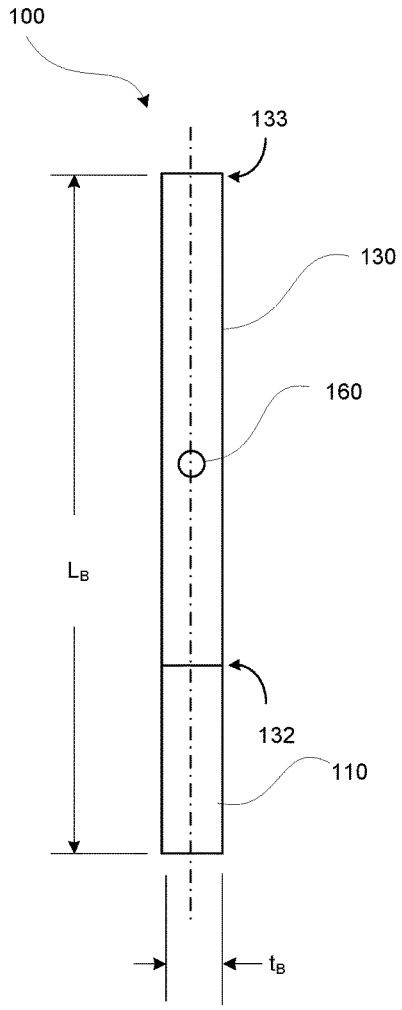
FIG. 3*b* is a side view of the anchor of FIG. 3*a;*
Figure 4:
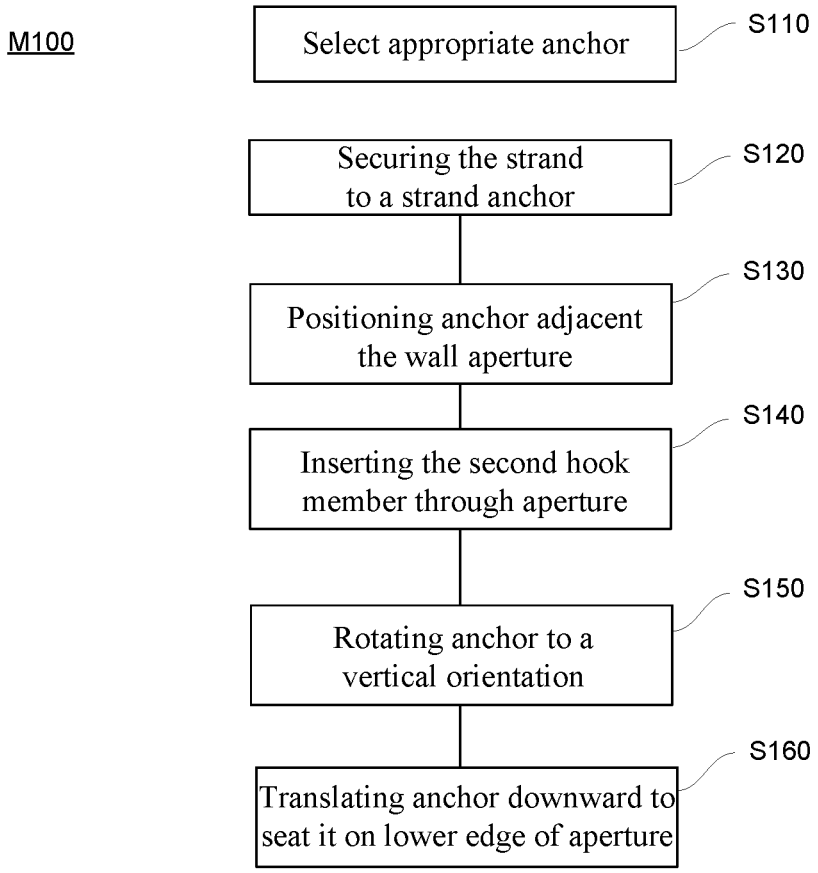
FIG. 4 is a flow diagram of a method of securing a strand according to an embodiment of the invention.

FIGS. 3*a* and 3*b* illustrate a strand anchor 100 according to an illustrative embodiment of the invention. As discussed above, the anchor is configured for securing a strand from an aperture in a wall having a thickness $t_W$, where the aperture has a maximum width dimension $w_A$ that is greater than its maximum height dimension $h_A$. The anchor has a generally elongate, rectangular main anchor body member 110 having a longitudinal axis 111 parallel to its long dimension. The body member 110 has a strand attachment end 112 and a hook attachment end 113. As shown in FIG. 3*a*, the strand attachment end 112 and the hook attachment end 113 of the anchor body member may be rounded. The anchor body member 110 has a length $L_B$ that extends from the strand attachment end 112 to the hook attachment end 113 along a line parallel to the longitudinal axis 111. The body member 110 is substantially planar with a thickness $t_B$ and has a lateral edge defining a first wall engagement surface 114. A strand-securing aperture 115 may be formed through the anchor body member 110 adjacent the strand attachment end 112. While depicted as circular in FIG. 3*a*, the strand-securing aperture 115 may be any shape adapted to accommodate a particular strand type or connector. The anchor body member 110 may also have a hand-grip aperture 150 formed there-through to facilitate ease of gripping and manipulating the anchor 100.

The anchor 100 has first and second hook members 120, 130 attached to the anchor body 110 to form a slot 140 sized and configured for receiving a portion of a wall. The first and second hook members 120, 130 may also be substantially planar and may have the same thickness as the main body member 110. In particular embodiments, the main body member 110 and the first and second hook members 120, 130 are integrally formed as a single planar member having a constant thickness.

The first hook member 120 is attached to the anchor body member 110 adjacent its hook attachment end 113 so that it extends laterally at a right angle from the main body member 110. The first hook member 120 has a lower edge that defines a second wall engagement surface 124 that extends perpendicularly from the first wall engagement surface 114. The generally elongate second hook member 130 is attached to the first hook member 120 at a hook member attachment end 133 and extends downward therefrom so that it is generally parallel to the main body member 110 and terminates in a free hook member end 132.

The second hook member 130 has a longitudinal length $L_H$ from the hook member attachment end 133 to the free hook member end 132. The second hook member 130 has an inner lateral edge defining a third wall engagement surface 134 that opposes and is parallel to the first wall engagement surface 114. In some embodiments, the outer lateral edge 135 of the second hook member 130 may be tapered and the tip at the free hook member end 132 rounded to facilitate installation of the anchor 100.

The first and third engagement surfaces 114, 134 define the slot 140, which has an opening adjacent free hook member end 132 and terminates at the second wall engagement surface 124. The distance from the free hook member end 132 to the second wall engagement surface 124 may be defined as the slot length $L_S$. The spacing between the first and third engagement surfaces 114, 134 may be defined as the slot width $W_S$.

It will be understood that the first and second hook members 120, 130 may be sized and configured to establish desired slot dimensions. In particular, the slot width $W_S$ can be established to accommodate a particular wall thickness. In particular embodiments, the first and second hook members 120, 130 may be configured to provide a slot width $W_S$ that is just slightly greater than the thickness of the wall. The second hook member 130 may also be sized and configured so that its longitudinal length $L_H$ is less than the maximum expected aperture width dimension and greater than the maximum expected aperture height dimension. In some preferred embodiments, the longitudinal length $L_H$ may be sized to be as long as possible while still fitting through the max width portion of the aperture. As will be discussed, this maximizes the amount of wall engagement overlap that remains—and, thus, the safety factor—when a vertical uplift causes the anchor to move vertically from its fully installed configuration.

Figure 5A:
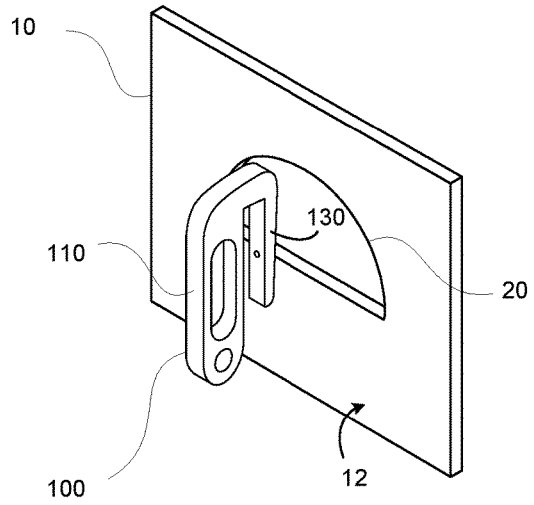
FIGS. 5*a*-5*e* illustrate a sequence of operations in a method of securing a strand according to an embodiment of the invention.
Figure 5B:
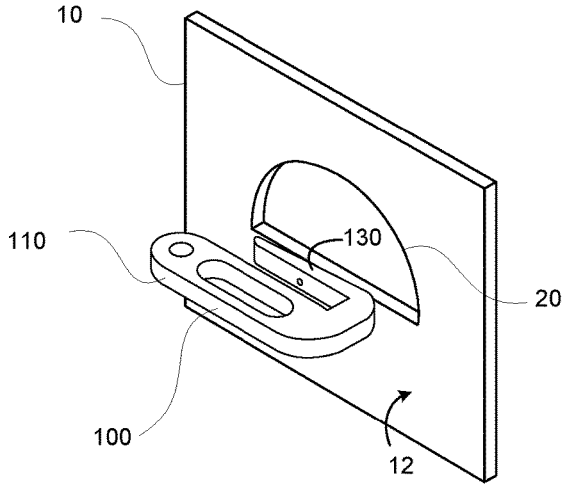
Figure 5C:
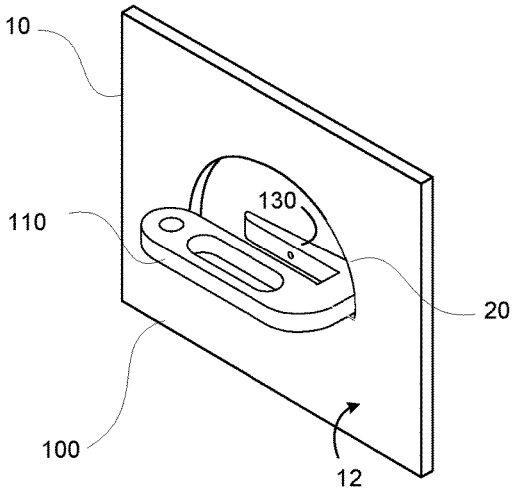
Figure 5D:
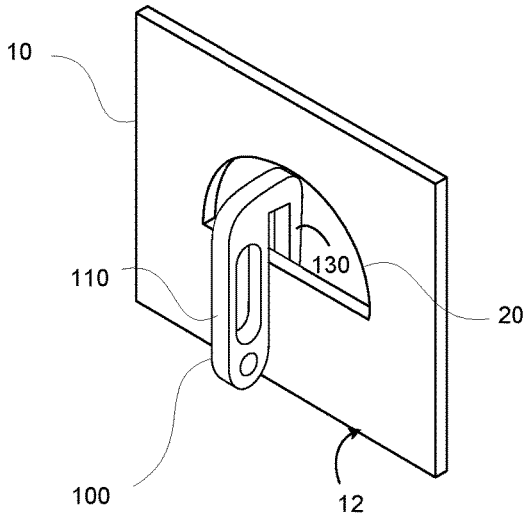
Figure 5E:
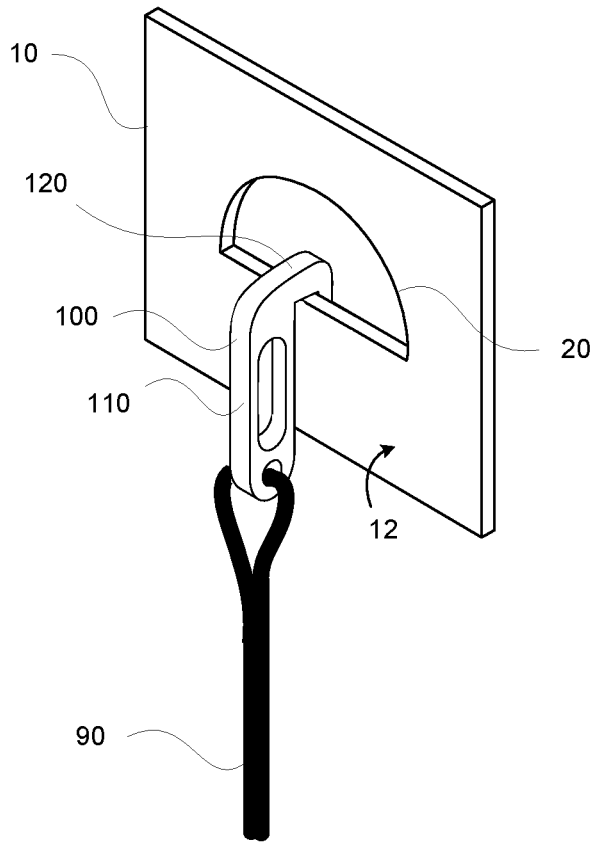

As will be discussed in more detail hereafter, when the anchor 100 is installed on a wall, a portion of the wall is received into the slot 140. The anchor 100 is configured so that when it is in this configuration, it can translate vertically but is prevented from translating so far that the wall portion escapes the slot 140. The anchor 100 may also be able to translate horizontally for small distances. In some cases, however, it may be desirable to minimize or eliminate the tendency for the anchor to translate from its installed condition. Toward that end, the anchor 100 may include a locking mechanism to hold the anchor in place. This may include any form of clamping or securing mechanism. In particular embodiments, the locking mechanism may comprise a set screw. In the illustrated example of FIGS. 3*a* and 3*b*, the locking mechanism includes a threaded set screw passage 160 for receiving a set screw (not shown). When the anchor is in an installed configuration (see, e.g., FIG. 5*a*), the set screw may be threaded into and through the passage 160 to engage the back face of the wall and hold the anchor 100 in place.

The anchors of the invention may be formed from any material having sufficient strength for a particular application. These may include, by way of example, steel and other ferrous metals, non-ferrous metals, plastics, polymers, and composite structures. In an exemplary application for use in securing a lifeline for a single worker to a wall having a thickness of 0.375 in., an anchor was formed from plate steel having a nominal thickness of 0.625 in. This was accomplished by cutting the entire anchor 100 to the desired configuration and dimensions from plate steel using a CNC plasma cutting machine.

With reference to FIGS. 4 and 5*a*-5*e*, a method M100 of anchoring a strand using the anchor 100 according to an embodiment of the invention will now be described. FIGS. 5*a*-5*e* illustrate a sequence of positions of the anchor 100 relative to an aperture 20 formed through a wall 10. For simplicity, only a portion of the wall 10 surrounding the aperture 20 is shown. The illustrated aperture 20 is a half-moon aperture substantially similar to that of FIG. 2 with a maximum width $W_A$ at its base and a maximum height $H_A$. At S110 of the method M100, a user may select the appropriately sized anchor 100 for the wall 10 and the aperture 20. In particular, the anchor 100 may be selected so that the width of the slot 140 is greater than the wall thickness and the length of the second hook member 130 is greater than $H_A$ but less than $W_A$.

At S120 of the method M100, the strand may be secured to the anchor 100. It will be understood that this action may be taken at any time before, during, or after the actions of installing the anchor 100 in the aperture 20. Securing of the strand may be accomplished by threading a portion of the strand through the strand-securing aperture 115 as exemplified by the cable strand 90 in FIG. 5*e*. The strand 90 or other strand type may alternatively be secured to the anchor 100 through any suitable attachment mechanism, including but not limited to shackles, carabiners, clasps, and hooks.

Figure 6A:
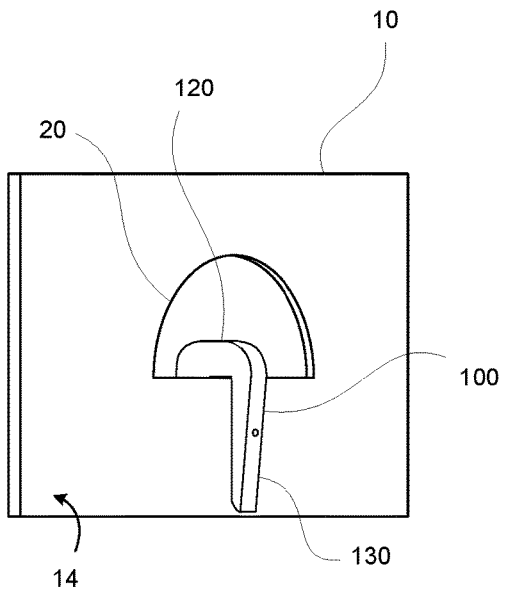
FIG. 6*a* is a back-side view of an installed anchor according to an embodiment of the invention.

The strand anchor 100 is secured to the wall 10 in aperture 20 through the actions S130, S140, S150 and S160, which place the anchor 100 in an installed condition in which a portion of the anchor 100 is disposed through the aperture 20 and a portion of the wall 10 is disposed within the slot 140. In this condition (best seen in FIGS. 5*e* and 6*a*), at least a portion of the first wall engaging surface 114 is adjacent or in contact with the front wall face 12 and at least a portion of the third wall engaging surface 134 is adjacent or in contact with the back wall face 14. Preferably, in the installed condition, the second wall engaging surface 124 is in contact with the wall 10 at the base edge of the aperture 20.

To attain the installed condition, the strand anchor 100, at S130, is positioned adjacent the wall aperture 20 with the second hook member 130 parallel to the portion of the wall aperture 20 defining its maximum width dimension. See FIG. 5*b*. At S140, the second hook member 130 is inserted through the wall aperture 20 and, at S150, the entire anchor 100 is rotated to a vertical orientation so that a portion of the wall 10 at the base of the aperture 20 is received into the slot 140. See FIGS. 5*c* and 5*d*. At this stage, the anchor is secured to the extent that it cannot be removed from the aperture 20 without rotating back to a horizontal configuration. A final installed configuration may be attained at S150, by translating the strand anchor downward until the second wall engagement surface 124 engages the wall 10 the base edge of the aperture 20. See FIG. 5*e* and FIG. 6*a*.

Figure 6B:
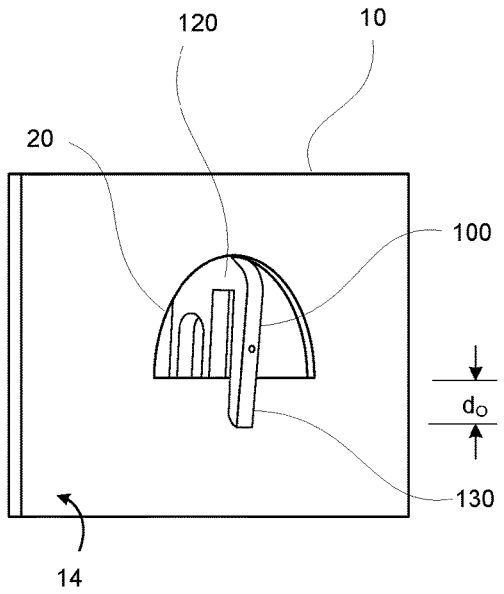
FIG. 6*b* is a back-side view of the anchor of FIG. 6*a* where the anchor has been translated vertically from the installed condition of FIG. 6*a*.

Once the anchor 100 has been placed in its installed condition, a tensile force can safely be applied to the attached strand. The anchor's configuration is such that, even if an upward force results in the anchor moving vertically, the vertical movement is limited by contact with the upper edge of the aperture 20 as shown in FIG. 6*b*. Further, because the length of the second hook member 130 exceeds the height of the aperture 20, there is an overlap distance do where the third wall engagement surface 134 remains adjacent or in contact with the back face 14 of the wall 10. This overlap provides a margin of security against the possibility of the anchor 20 being inadvertently withdrawn from the aperture 20.

It will be readily understood by those persons skilled in the art that the present invention is susceptible to broad utility and application. Many embodiments and adaptations of the present invention other than those herein described, as well as many variations, modifications and equivalent arrangements, will be apparent from or reasonably suggested by the present invention and foregoing description thereof, without departing from the substance or scope of the invention.

What is claimed is:

1. An anchor for securing a strand from an aperture in a wall having a front wall face and a back wall face defining a wall thickness there-between, the aperture having a maximum height dimension and a maximum width dimension that is greater than the maximum height dimension, the anchor comprising:

an anchor body member having a longitudinal axis and a parallel longitudinal body length dimension running from a strand attachment end of the anchor body member to a hook attachment end of the anchor body member, a first wall engagement surface on a lateral side of the anchor body member, and a strand-securing aperture formed through the anchor body member adjacent the strand attachment end;

a first hook member attached to the anchor body member adjacent the hook attachment end and extending laterally there-from in a direction perpendicular to the longitudinal axis, the first hook member having a second wall engagement surface intersecting and perpendicular to the first wall engagement surface; and a second hook member attached to the first hook member and having a longitudinal hook length dimension running from a hook member attachment end to a free hook member end and also having a third wall engagement surface parallel to, spaced apart from and opposing the first wall engagement surface, the first and third engagement surfaces defining a slot having a slot width that is greater than the wall thickness, wherein the longitudinal hook length dimension is less than the maximum aperture width dimension and greater than the maximum aperture height dimension, and wherein the longitudinal body length dimension is greater than the maximum aperture width dimension.

2. An anchor according to claim 1 wherein the anchor body and first and second hook members are formed as an integral monolithic anchor body.

3. An anchor according to claim 2 wherein the integral monolithic anchor body is substantially planar.

4. An anchor according to claim 1 further comprising:

a locking mechanism for securing the anchor to the wall when the anchor is in an installed condition in which a portion of the anchor is disposed through the aperture and a portion of the wall is disposed within the slot.

5. An anchor according to claim 4 wherein the locking mechanism comprises a set screw threaded within a set screw passage through the second hook member for operative engagement with the back wall face when the anchor is in the installed condition.

6. A method of anchoring a strand for suspension from an aperture in a vertical wall having a front wall face and a back wall face defining a wall thickness there-between, the aperture having a maximum height dimension and a maximum width dimension that is greater than the maximum height dimension, the method comprising:

providing a strand anchor comprising an anchor body member having a longitudinal axis and a parallel longitudinal body length dimension running from a strand attachment end of the anchor body member to a hook attachment end of the anchor body member, a first wall engagement surface on a lateral side of the anchor body member, and a strand-securing aperture formed through the anchor body member adjacent the strand attachment end, a first hook member attached to the anchor body member adjacent the hook attachment end and extending laterally there-from in a direction perpendicular to the longitudinal axis, the first hook member having a second wall engagement surface intersecting and perpendicular to the first wall engagement surface, and a second hook member attached to the first hook member and having a longitudinal hook length dimension running from a hook member attachment end to a free hook member end and also having a third wall engagement surface parallel to, spaced apart from and opposing the first wall engagement surface, the first and third engagement surfaces defining a slot having a slot width that is greater than the wall thickness, a locking mechanism comprising a set screw threaded within a set screw passage through the second hook member for operative engagement with the back wall face when the anchor is in an installed condition in which a portion of the anchor is disposed through the aperture and a portion of the wall is disposed within the slot with at least a portion of the first wall engaging surface being adjacent or in contact with the front wall face and at least a portion of the third wall engaging surface being adjacent or in contact with the back wall face, wherein the longitudinal hook length dimension is less than the maximum aperture width dimension and greater than the maximum aperture height dimension;

securing the strand to the strand anchor using the strand-securing aperture;

placing the strand anchor in the installed condition; and rotating the set screw to engage the back wall face, thereby locking the strand anchor in the installed condition.

7. A method according to claim 6 wherein the action of placing the strand anchor in an installed condition includes:

positioning the strand anchor adjacent the wall aperture so that the second hook member is parallel to a portion of the wall aperture defining the maximum width dimension;

inserting the second hook member through the portion of the wall aperture defining the maximum width dimension; and rotating the strand anchor to a vertical orientation so that the portion of the wall is received into the slot.

8. A method according to claim 7 wherein the action of placing the strand anchor in an installed condition further includes:

translating the strand anchor downward until the second wall engagement surface engages the wall at an edge of the aperture.

9. A method according to claim 6 wherein the longitudinal body length dimension of the strand anchor is greater than the maximum aperture width dimension.

10. A method according to claim 6 wherein the anchor body and first and second hook members are formed as a planar monolithic anchor body.

11. An anchor for securing a strand from an aperture in a wall having a front wall face and a back wall face defining a wall thickness there-between, the aperture having a maximum height dimension and a maximum width dimension that is greater than the maximum height dimension, the anchor comprising:

an anchor body member having a longitudinal axis and a parallel longitudinal body length dimension running from a strand attachment end of the anchor body member to a hook attachment end of the anchor body member, a first wall engagement surface on a lateral side of the anchor body member, and a strand-securing aperture formed through the anchor body member adjacent the strand attachment end;

a first hook member attached to the anchor body member adjacent the hook attachment end and extending laterally there-from in a direction perpendicular to the longitudinal axis, the first hook member having a second wall engagement surface intersecting and perpendicular to the first wall engagement surface;

a second hook member attached to the first hook member and having a longitudinal hook length dimension running from a hook member attachment end to a free hook member end and also having a third wall engagement surface parallel to, spaced apart from and opposing the first wall engagement surface, the first and third engagement surfaces defining a slot having a slot width that is greater than the wall thickness; and a locking mechanism for securing the anchor to the wall when the anchor is in an installed condition in which a portion of the anchor is disposed through the aperture and a portion of the wall is disposed within the slot, the locking mechanism comprising a set screw threaded within a set screw passage through the second hook member for operative engagement with the back wall face when the anchor is in the installed condition, wherein the longitudinal hook length dimension is less than the maximum aperture width dimension and greater than the maximum aperture height dimension.

12. An anchor according to claim 11 wherein the longitudinal body length dimension is greater than the maximum aperture width dimension.

13. An anchor according to claim 11 wherein the anchor body and first and second hook members are formed as an integral monolithic anchor body.

14. An anchor according to claim 13 wherein the integral monolithic anchor body is substantially planar.

* * * * *